US007708440B2

(12) United States Patent
Hamada et al.

(10) Patent No.: US 7,708,440 B2
(45) Date of Patent: May 4, 2010

(54) ELECTRIC BALLAST AND A LIGHTING SYSTEM

(75) Inventors: Hideki Hamada, Nishikanbara-gun (JP); Shojiro Kido, Nishikanbara-gun (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 279 days.

(21) Appl. No.: 11/795,498

(22) PCT Filed: Nov. 18, 2005

(86) PCT No.: PCT/JP2005/021219

§ 371 (c)(1),
(2), (4) Date: Jul. 18, 2007

(87) PCT Pub. No.: WO2006/080131

PCT Pub. Date: Aug. 3, 2006

(65) Prior Publication Data

US 2008/0123345 A1 May 29, 2008

(30) Foreign Application Priority Data

Jan. 25, 2005 (JP) ..... 2005-017155
Jan. 25, 2005 (JP) ..... 2005-017156

(51) Int. Cl.
*B60Q 1/04* (2006.01)

(52) U.S. Cl. ..... 362/547; 362/294; 362/373; 362/548

(58) Field of Classification Search ..... 362/221, 362/547, 548, 264, 265, 294, 373
See application file for complete search history.

(56) References Cited

U.S. PATENT DOCUMENTS 5,107,405 A * 4/1992 Makita ..... 362/467

(Continued)

FOREIGN PATENT DOCUMENTS

DE 195 43 852 A1 5/1997

(Continued)

OTHER PUBLICATIONS

International Search Report for Int'l Appln. No. PCT/JP2005/021219.

(Continued)

*Primary Examiner*—Sandra L O'Shea
*Assistant Examiner*—Leah S Lovell
(74) *Attorney, Agent, or Firm*—Cheng Law Group, PLLC

(57) ABSTRACT

An electric ballast attached to the outside of a lighting system. The system comprises a lamp housing with front and rear openings, a front lens closing the front opening, a discharge lamp put in the housing, and a reflector that reflects light of the lamp toward the lens. The ballast comprises: a ballast housing which closes the rear opening and is connected with frame ground via at least one of the lamp housing and the reflector; a lamp socket and an igniter, put in the front of the ballast housing; and a power converter put in the ballast housing. The output of the converter is connected with the socket, which directly connects with the lamp, and the igniter is connected between them. Heat generating parts of the converter are put in the rear of the ballast housing, and the rear functions as a radiator.

16 Claims, 13 Drawing Sheets

U.S. PATENT DOCUMENTS

| | | | | |
|---|---|---|---|---|
| 6,364,515 | B1 | 4/2002 | Daub et al. | |
| 6,486,614 | B1 | 11/2002 | Nakano | |
| 6,619,817 | B1 | 9/2003 | Kataoka et al. | |
| 6,644,842 | B2 * | 11/2003 | Yamaguchi | 362/547 |
| 6,919,687 | B2 * | 7/2005 | Kika | 315/57 |
| 2001/0014022 | A1 | 8/2001 | Frey et al. | |
| 2002/0167818 | A1 | 11/2002 | Yoneima | |
| 2003/0058656 | A1 | 3/2003 | Yamaguchi | |
| 2003/0146718 | A1 | 8/2003 | Horiuchi et al. | |

FOREIGN PATENT DOCUMENTS

| | | | |
|---|---|---|---|
| EP | 1 273 848 | A1 | 1/2003 |
| FR | 2776365 | | 9/1999 |
| JP | 62-53512 | U | 4/1987 |
| JP | 06-325950 | | 11/1994 |
| JP | 7-114805 | A | 5/1995 |
| JP | 8-7621 | A | 1/1996 |
| JP | 10-321007 | A | 12/1998 |
| JP | 2000-149642 | A | 5/2000 |
| JP | 2000-173311 | | 6/2000 |
| JP | 2000-195685 | | 7/2000 |
| JP | 2001-101908 | A | 4/2001 |
| JP | 2001-101909 | A | 4/2001 |
| JP | 2001-126886 | A | 5/2001 |
| JP | 2001-338506 | A | 12/2001 |
| JP | 2002-285309 | A | 1/2002 |
| JP | 2002-343128 | A | 11/2002 |
| JP | 2002-367414 | A | 12/2002 |
| JP | 2003-31026 | A | 1/2003 |
| JP | 2003-68134 | | 3/2003 |
| JP | 2003-280096 | | 10/2003 |
| JP | 2003-317535 | | 11/2003 |

OTHER PUBLICATIONS

Supplementary European Search Report for the Application No. EP 05 80 7093 dated Jul. 6, 2009.

Notification of Reasons for Refusal for the Application No. 2005-017155 from Japan Patent Office mailed Aug. 18, 2009.

Notification of Reasons for Refusal for the Application No. 2005-017155 from Japan Patent Office mailed Nov. 10, 2009.

* cited by examiner

ELECTRIC BALLAST AND A LIGHTING SYSTEM

TECHNICAL FIELD

The invention relates to lighting systems such as, for example, headlights, fog lights or the like, and in particular, to an electric ballast for the system.

BACKGROUND ART

A prior art device described in Japanese Patent Application Publication No. 2001-338506 includes an electric ballast for a vehicle lighting system that comprises a lamp housing with front and rear openings, a front lens closing the front opening, a discharge lamp put in the housing, and a reflector put in the housing to reflect light of the lamp toward the lens. The ballast is formed of a ballast housing closing said rear opening, and an inverter and an igniter which are put in the ballast housing. The ballast is also electrically connected with the lamp via a wire harness (wires and connectors) and a lamp socket.

Another prior art device described in Japanese Patent Application Publication No. 2002-367414 includes an electric ballast for a vehicle lighting system that comprises a lamp housing with front and rear openings, a front lens closing the front opening, a cap closing the rear opening, a discharge lamp put in the housing, and a reflector put in the housing to reflect light of the lamp toward the lens. This ballast is formed of an inverter mounted on the inner face of the cap, and an igniter put in a lamp socket within the lamp housing. These inverter and igniter are electrically connected each other through a wire harness including wires.

In these prior art devices and other similar prior art devices (e.g., France Patent Publication No. 2776365, U.S. Pat. No. 6,364,515 and Japanese Patent Application Publication Nos. 2001-101908 and 2002-343128), the wires within a lamp housing need be covered with a costly sheath shield such as a mesh shield or the like in the same way as, for example, a device described in Japanese Patent Application Publication No. 2000-195685. Because there is a possibility that noise generated from a discharge lamp caused by polarity inversing of a lamp current enters each portion of a ballast through the wires to cause wrong operation of devices.

Other prior art devices described in Japanese Patent Application Publication Nos. 2001-101909 and 2003-317535 are provided with a ballast housing that includes a lamp socket or a discharge lamp in addition to an inverter and an igniter. According to these devices, the need of said sheath shield is eliminated. However, if the ballast housing does not have a shield function, said possibility of the wrong operation remains. In the latter, especially, a seal member (insulating member or elastic moulding) exposed from the inside of the ballast housing touches the lamp housing. The former also has the ballast housing inside the lamp housing, and accordingly its ballast is exposed to high temperature within the lamp housing, so that heat generating parts (high temperature parts) of the ballast become extremely high temperature.

It is an object of the present invention to eliminate the need of a shield sheath in a lamp housing, and also to protect heat generating parts of an electric ballast from high temperature in the lamp housing.

DISCLOSURE OF THE INVENTION

The present invention is an electric ballast attached to the outside of a lighting system. The lighting system comprises a lamp housing with a front opening and a rear opening, a front lens closing the front opening, a discharge lamp put in the lamp housing, and a reflector put in the lamp housing to reflect light of the lamp toward the lens. The electric ballast comprises: a ballast housing which closes the rear opening and is electrically connected with frame ground via at least one of the lamp housing and the reflector; a lamp socket which is put in the front of the ballast housing and directly connects with the lamp; a power converter which is put in the ballast housing and of which output is electrically connected with the socket; and an igniter which is put in the front of the ballast housing and is electrically connected between the power converter and the socket. Heat generating parts of the power converter are put in the rear of the ballast housing, and the rear of the ballast housing functions as a radiator.

In this configuration, since the lamp socket and the igniter are put in the front of the ballast housing, attenuation of pulse voltage can be reduced. Since the ballast housing is electrically connected with frame ground in particular, it is possible to achieve better shield effect of the ballast housing with respect to noise from the lamp, and the need of a shield sheath in the lamp housing can be eliminated. As a result, cost down and a compact system are achieved. Moreover, the heat generating parts are put in the rear of the ballast housing and the rear of the ballast housing functions as a radiator, and accordingly the heat generating parts can be protected from high temperature in the lamp housing. Consequently, low heat-resistant heat generating parts can be used and the cost is reduced.

In a preferable embodiment, the electric ballast further comprises a loop-shaped elastic coupling with an inner peripheral edge and an outer peripheral edge. The inner peripheral edge and the outer peripheral edge of the elastic coupling are respectively joined to the rear of the reflector and the peripheral edge of the rear opening so that the elastic coupling movably supports the reflector. The ballast housing is fixed on the rear of the reflector and also electrically connected with the reflector. In this configuration, the rear opening side of the lamp housing is made waterproof. By moving the reflector, the optical axis of the lamp can be adjusted. For example, lighting systems suitable for headlights can be provided.

In another preferable embodiment, the electric ballast further comprises a loop-shaped elastic coupling with an inner peripheral edge and an outer peripheral edge. The ballast housing is fixed on the rear of the reflector and also electrically connected with the reflector. The inner peripheral edge and the outer peripheral edge of the elastic coupling are respectively joined to the ballast housing and the peripheral edge of the rear opening so that the elastic coupling movably supports the reflector through the ballast housing. In this configuration, the rear opening side of the lamp housing is made waterproof. By moving the reflector, the optical axis of the lamp can be adjusted. For example, lighting systems suitable for headlights can be provided.

In other preferable embodiment, the ballast housing is fixed on the lamp housing with the rear opening close, and also electrically connected with the lamp housing. In this configuration, the rear opening side of the lamp housing is made waterproof. For example, lighting systems suitable for fog lights can be provided.

In an enhanced embodiment, the electric ballast further comprises a filter which is located between the power converter and the igniter and has two series capacitors connected in parallel with the lamp through the igniter. The ballast housing is electrically connected between the series capacitors. In this configuration, noise from the lamp can be further reduced.

In an alternate embodiment, the igniter includes a switch for trigger. The switch is a discharge gap for self-excitation or a semiconductor switch for separately-excitation. For example, in case that the semiconductor switch is used, the upper limit value of pulse voltage can be restricted and accordingly compact systems are realized.

In another alternate embodiment, the power converter and the igniter are mounted on the same substrate. According to this configuration, compact systems are realized.

In other alternate embodiment, at least one of the power converter and the igniter includes a transformer with windings each of which is formed of pattern wiring of a substrate. According to this configuration, compact systems are realized.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1:
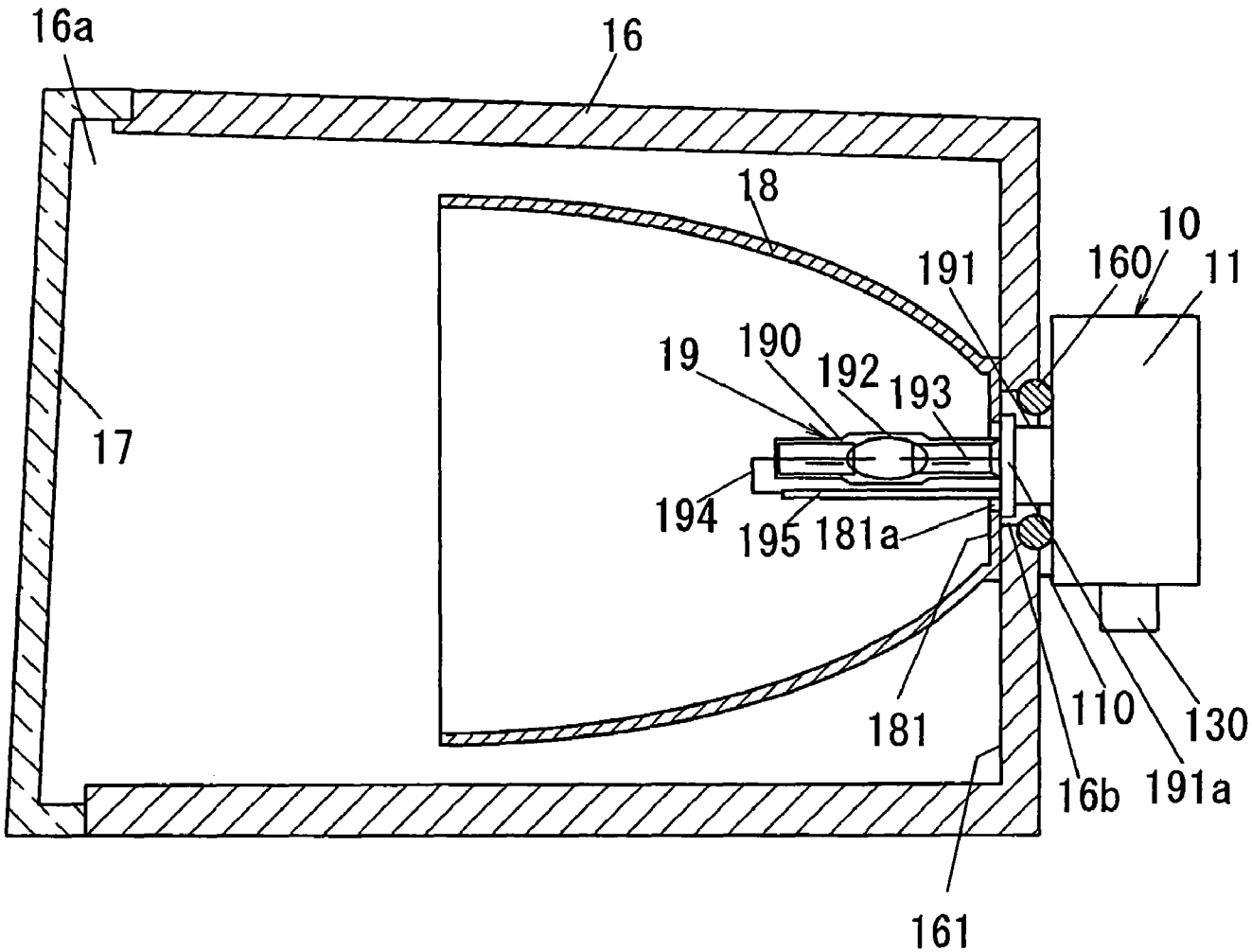
FIG. 1 is a sectional view of a lighting system, in accordance with a first embodiment of the present invention.

FIG. 1 shows a lighting system in accordance with a first embodiment of the present invention. The lighting system of FIG. 1 is a vehicle lighting system such as headlights, fog lights or the like, and is, for example, a fog light in the first embodiment. This system is formed of a lamp housing 16, a front lens 17, a reflector 18, a discharge lamp 19 and an electric ballast 10.

The lamp housing 16 is, for example, a case in which the reflector 18 and the discharge lamp 19 are put, and has a front opening 16*a* and a rear opening l6*b*. The opening 16*b* is formed at the bottom 161 of the housing 16. The housing 16 is formed of conductive materials such as, for example, metal or the like. In case of fog lights, the lamp housing is usually connected with frame ground. The housing 16 is also connected with frame ground.

The front lens 17 is formed of materials for translucency to close the front opening 16*a*. The lens 17 is fixed on the edge of the front opening 16*a* with, for example, adhesive such as hot melt or the like, or a seal such as a rubber packing or the like. That is, the front opening 16*a* side of the housing 16 is made waterproof.

The reflector 18 is, for example, a parabolic reflector formed of conductive materials such as metal or the like, and has a hole 181*a* through which the lamp 19 is inserted. The hole 181*a* is formed at the bottom 181 of the reflector 18. The reflector 18 is also put in the housing 16 so as to reflect light of the lamp 19 toward the lens 17.

Figure 2:
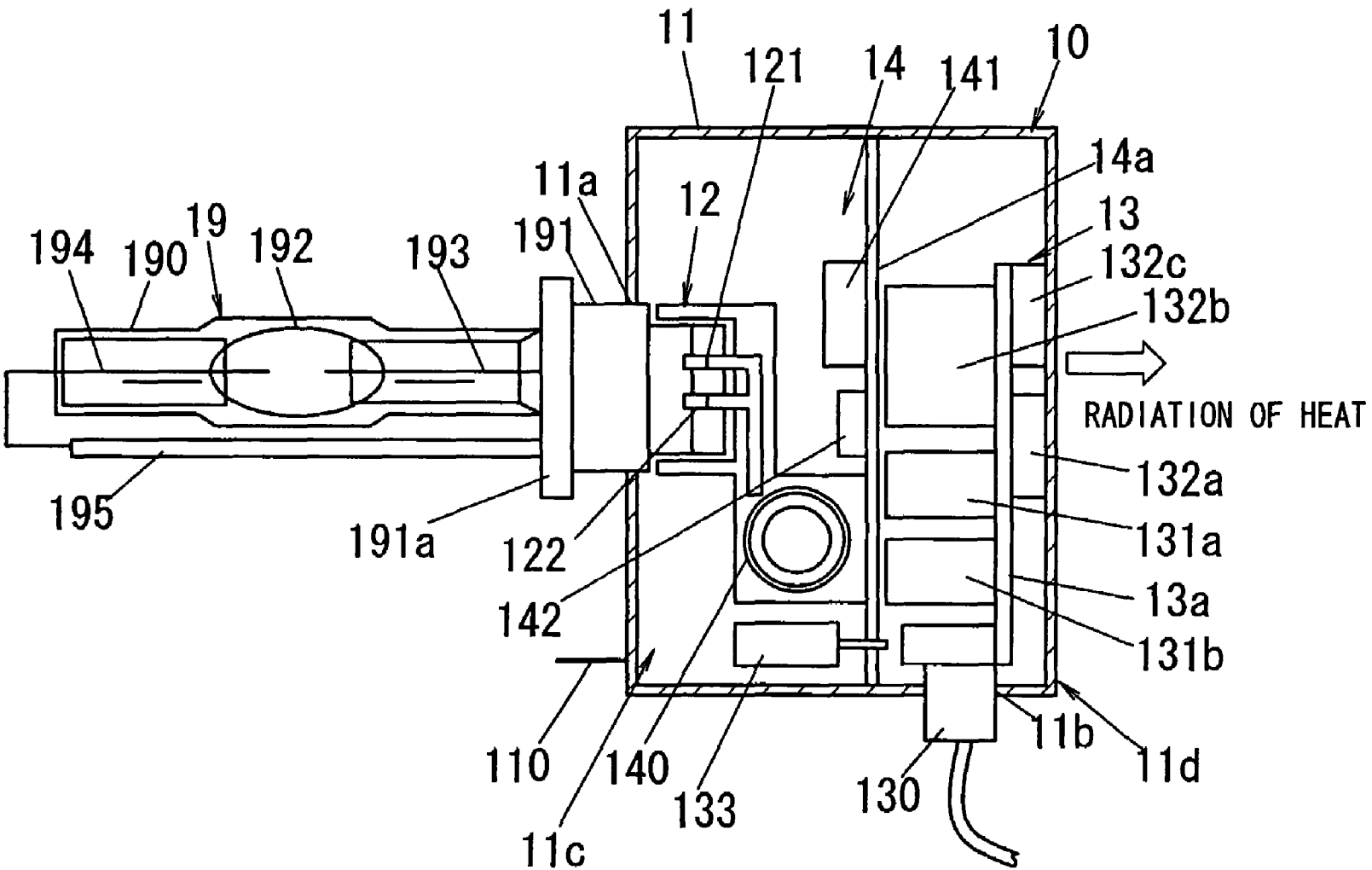
FIG. 2 is a sectional view of an electric ballast in FIG. 1.

As shown in FIGS. 1 and 2, the discharge lamp 19 is a single-base type lamp (e.g., HID (high intensity discharge) lamp), and is put in the housing 16. The lamp 19 is formed of an outer glass envelope 190, a single base 191 that retains one end of the envelope 190, an arc tube 192 put in the envelope 190, an inner electrode 193 located between the base 191 and one end of the tube 192 through the inside of the envelope 190, an outer electrode 194 located between the base 191 and other end of the tube 192 through the outside of the envelope 190, and a protection tube 195 covering the outer electrode 194.

The single base 191 is provided therein with a pair of electrodes (not shown) electrically connected with the electrodes 193 and 194, respectively. The base 191 also has a flange 191*a* that is in contact with the bottom 181 of the reflector 18 in a state that the ballast 10 is attached to the outside of the lighting system. In this state, the rear opening 16*b* side of the housing 16 is made waterproof with a seal packing 160 sandwiched between the edge of the opening 16*b* and the ballast 10. The packing 160 is, for example, an O-ring such as a rubber molding, an elastic resin or the like.

Figure 3:
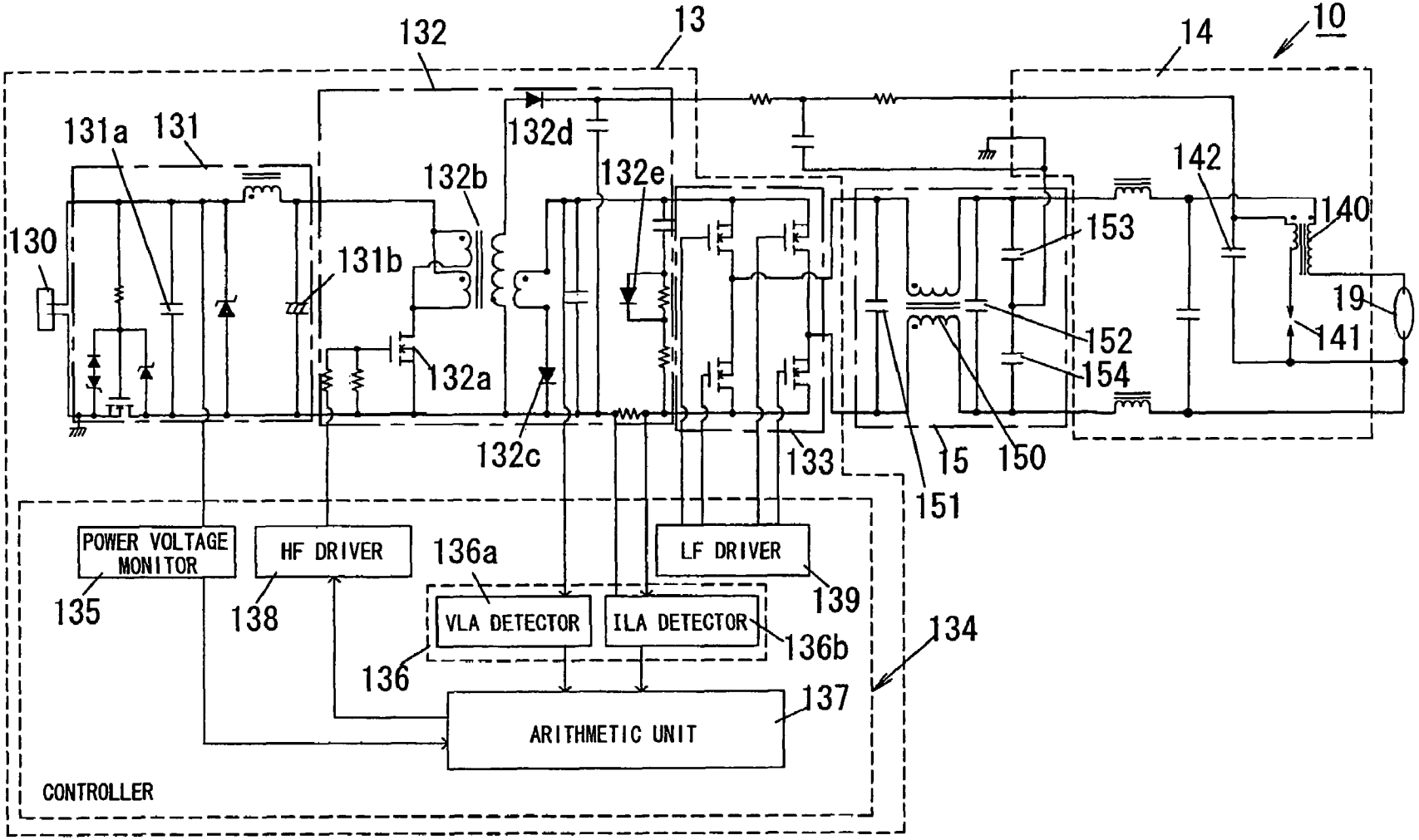
FIG. 3 is a circuit diagram of the electric ballast in FIG. 1.

As shown in FIGS. 2 and 3, the electric ballast 10 is formed of a ballast housing 11, a lamp socket 12, a power converter 13, an igniter 14 and a filter 15.

The ballast housing 11 is, for example, a case and a cover that are formed of conductive materials such as metal or the like, and has a front opening 11*a*, a bottom opening 11*b*, and a connecter 110 formed of conductive materials such as metal or the like. The ballast housing 11 is fixed to the outer face of the bottom 161 of the lamp housing 16 by a fixing means (not shown) such as, for example, screws, twist lock connectors or the like, and closes the rear opening 16*b* of the lamp housing 16. In this state, the ballast housing 11 is electrically connected with the lamp housing 16 by the fixing means and also the contact of the connecter 110 with the outer face of the bottom 161 of the lamp housing 16. Accordingly, it is possible to reduce noise in the FM band or TV band by polarity inversing of the lamp current from the lamp 19 without said costly sheath shield.

The lamp socket 12 has output terminals 121 and 122 of the ballast 10, and is put in the front 11*c* of the ballast housing 11. Also, the socket 12 directly connects with the lamp 19 by, for example, bayonet construction to support the lamp 12. The terminals 121 and 122 are electrically connected with the electrodes of the base 191, respectively.

As shown in FIGS. 2 and 3, the power converter 13 includes a power input coupler 130, an input filter 131, a DC-DC converter 132, an inverter 133 and a controller 134, and is put in the ballast housing 11.

The power input coupler 130 is located at the bottom opening 11*b* of the ballast housing 11, and is electrically connected with, for example, a 12V DC power source through a wire harness.

The input filter 131 is mainly a LC filter, and is located between the coupler 130 and the DC-DC converter 132. In an example of FIG. 3, the filter 131 is formed of electrolytic capacitors 131*a* and 131*b*, an inductor, diodes and an RCP (reverse connection protection) circuit.

The DC-DC converter 132 includes a forward type DC-DC converter for the inverter 133 and a flyback type DC-DC converter for the igniter 14, and is formed of a MOSFET 132*a*, a transformer 132*b*, diodes 132*c*-132*e*, capacitors and so on. The converter for the inverter 133 converts DC voltage from the DC power source into a stable light output of lamp 19 (DC voltage).

The inverter 133 is formed of, for example, a full bridge module of which output is electrically connected with the socket 12, and converts the DC voltage from the DC-DC converter 132 into square wave AC voltage. The square wave AC voltage is applied to the lamp 19.

The controller 134 is formed of a power voltage monitor 135, a detector 136, an arithmetic unit 137, an HF (high frequency) driver 138 and an LF (low frequency) driver 139. The monitor 135 detects DC voltage from the DC power source. The detector 136 includes a VLA detector 136*a* for detecting a value of output voltage of the converter for the inverter 133 and an ILA detector 136*b* for detecting a value of output current of the converter for the inverter 133. The arithmetic unit 137 provides the HF driver 138 with a control signal that causes a value of output power of the converter for the inverter 133 to be equal to a predetermined value based on both values from the detector 136. The HF driver 138 provides the MOSFET 132*a* with a PWM signal of which duty and frequency are adjusted in response to the control signal from the arithmetic unit 137. The LF driver 139 provides the inverter 133 with a signal that alternately turns on and off diagonal pairs of switches (four MOSFETs) in the inverter 133 at a low frequency.

As shown in FIGS. 2 and 3, said power converter 13 is provided with heat generating parts such as the MOSFET 132*a*, the diode 132*c* and so on, and therefore the heat generating parts are put in the rear 11*d* of the ballast housing 11. And the rear 11*d* functions as a radiator by locating the ballast housing 11 to the rear outside of the lamp housing 16. Specifically, the MOSFET 132*a*, the diode 132*c* and so on are mounted on the rear face of a substrate 13*a*, and heat from the heat generating parts is effectively released from the inside of the ballast housing 11 to the outside. Thereby, low-priced parts can be used. In addition, the capacitors 131*a* and 131*b*, the transformer 132*b* and so on are mounted on the front face of the substrate 13*a*, and the inverter 133 is mounted on a substrate 14*a*. These parts are fixed on the substrate 13*a* by, for example, soldering, brazing, conductive adhesive or the like.

The igniter 14 is electrically connected between the converter for the igniter 14 in the power converter 13 and the socket 12, and applies high pulse voltage across the lamp 19 to start the lamp 19. The igniter 14 is formed of, for example, a pulse transformer 140, a discharge gap 141 connected in series with a primary winding of the transformer 140, a capacitor 142 connected in parallel with the primary winding and gap 141, and so on. The output of the converter for the igniter 14 is electrically connected between the primary winding and the capacitor 142. A secondary winding of the transformer 140 is inserted in series to one of the output terminals 121 and 122 of the socket 12, and is located in proximity to the socket 12. Therefore, since distance between the secondary winding and the socket 12 is short, insulation distance and so on can be easily secured. The insulation distance prevents secondary occurrence of corona discharge in response to the pulse voltage. Attenuation of the pulse voltage is also prevented.

The igniter 14 also has a safety function that prevents occurrence of high voltage when the lamp 19 is not installed, and is put in the front 11*c* of the ballast housing 11. To be concrete, the transformer 140, the gap 141, the capacitor 142 and so on are mounted on the substrate 14*a* by, for example, soldering, brazing, conductive adhesive or the like. The substrate 14*a* is, for example, a print board, a resin substrate or the like.

The filter 15 includes an inductor (filter choke) 150 and capacitors 151-154, and is located between the converter for igniter 14 in the power converter 13 and the igniter 14. The inductor 150 and the capacitors 151-154 are mounted on the substrate 14*a* with, for example, soldering, brazing, conductive adhesive or the like. The capacitor 153 is connected in series with the capacitor 154, while the series combination of the capacitors 153 and 154 is connected in parallel with the lamp 19 through the igniter 14. And the joint of the capacitors 153 and 154 is electrically connected with the ballast housing 11 to be electrically connected with frame ground. Thus, the igniter 14 is protected by the electromagnetic shield and therefore it is possible to reduce noise in the FM band or TV band by polarity inversing of the lamp current from the lamp 19 without the costly sheath shield.

Said electric ballast 10 is detachably attached to the outside of the lamp housing 16. That is, the socket 12 of the ballast 10 is equipped with the base 191 of the lamp 19, and then the ballast housing 11 is fixed to the rear of the lamp housing 16 by said fixing means while inserting the lamp 19 into the rear opening 16*b* of the lamp housing 16 and the hole 18la of the reflector 18. At this point, since the ballast housing 11 is electrically connected with frame ground via the lamp housing 16, it is possible to achieve better shield effect of the ballast housing 11 with respect to noise from the lamp 19 and the need of a shield sheath in the lamp housing 16 can be eliminated. Consequently, cost down and compact systems are achieved.

In an alternate embodiment, the lighting system is a headlight and the ballast housing 11 is electrically connected with the reflector 18. In case of headlights, the reflector (18) is usually connected with frame ground. Therefore, the ballast housing 11 is electrically connected with frame ground via the reflector 18.

In another alternate embodiment, the igniter 14 is provided with a semiconductor switch for separately-excitation in stead of the discharge gap 141. The switch is turned on through a trigger circuit. According to this configuration, the upper limit value of the pulse voltage is restricted, further contributing to the compactness of the system.

Figure 4:
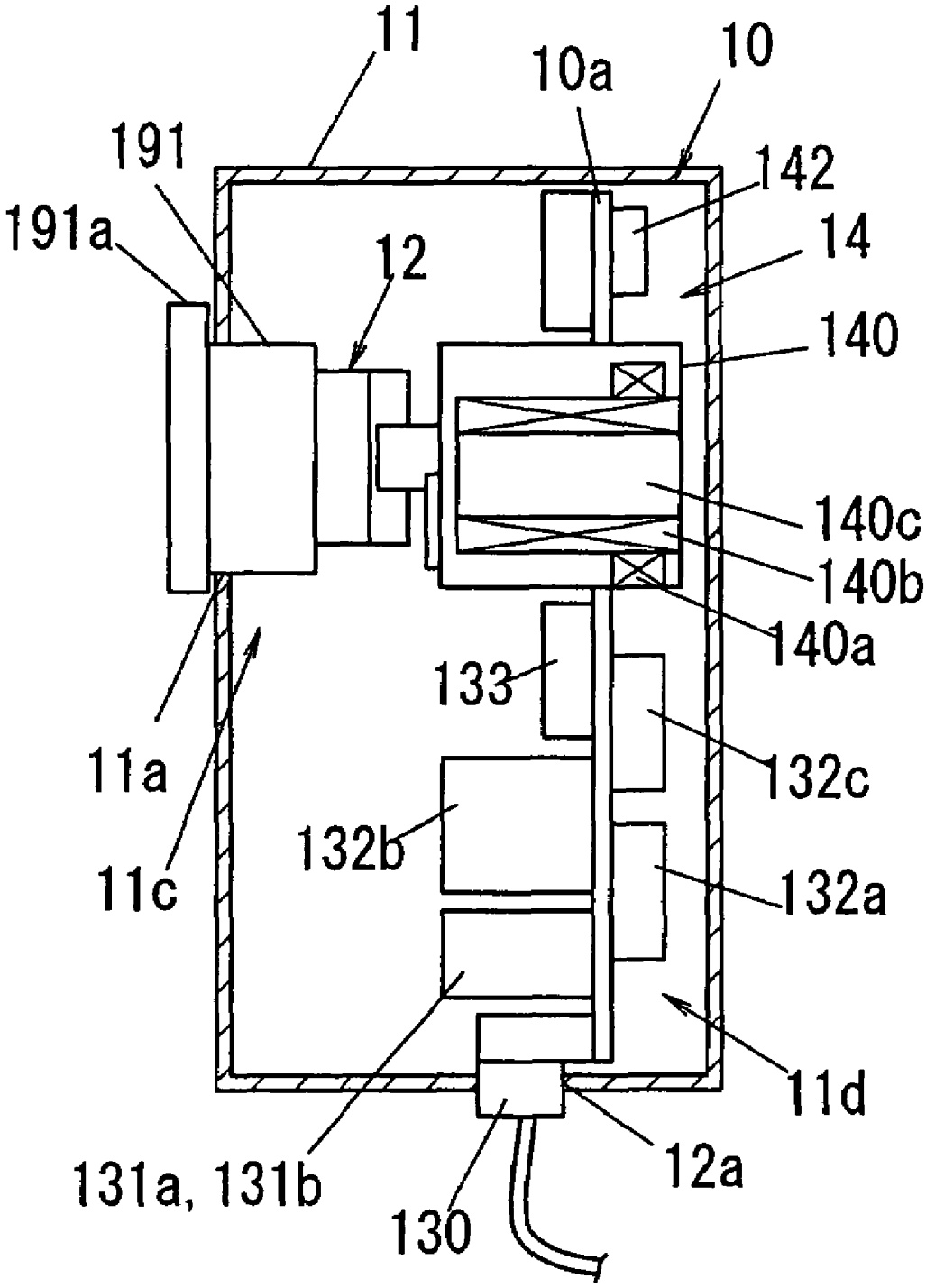
FIG. 4 is a sectional view of an electric ballast, in accordance with a varied embodiment of the present embodiment.
Figure 5:
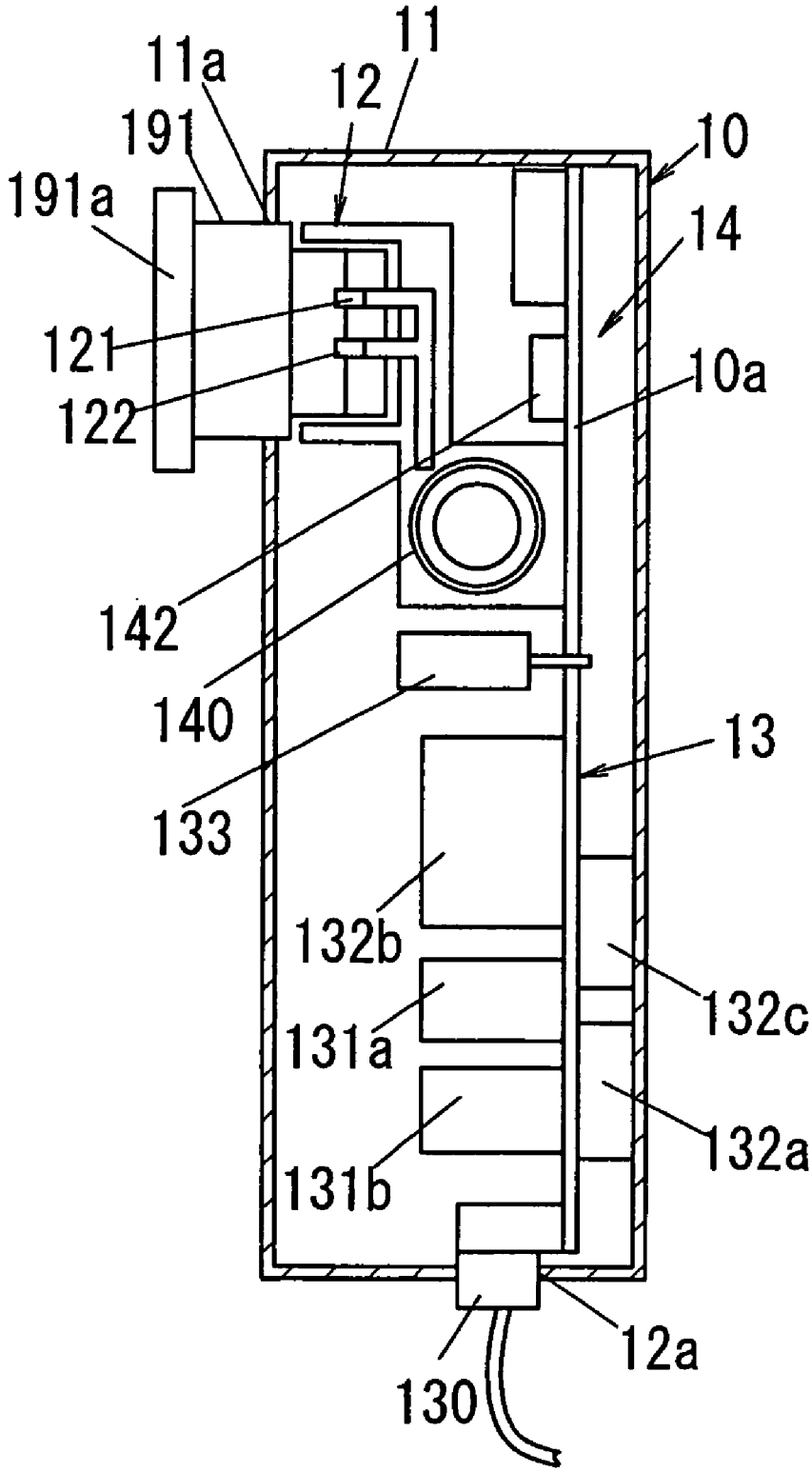
FIG. 5 is a sectional view of an electric ballast, in accordance with an alternate embodiment of the present embodiment.
Figure 6:
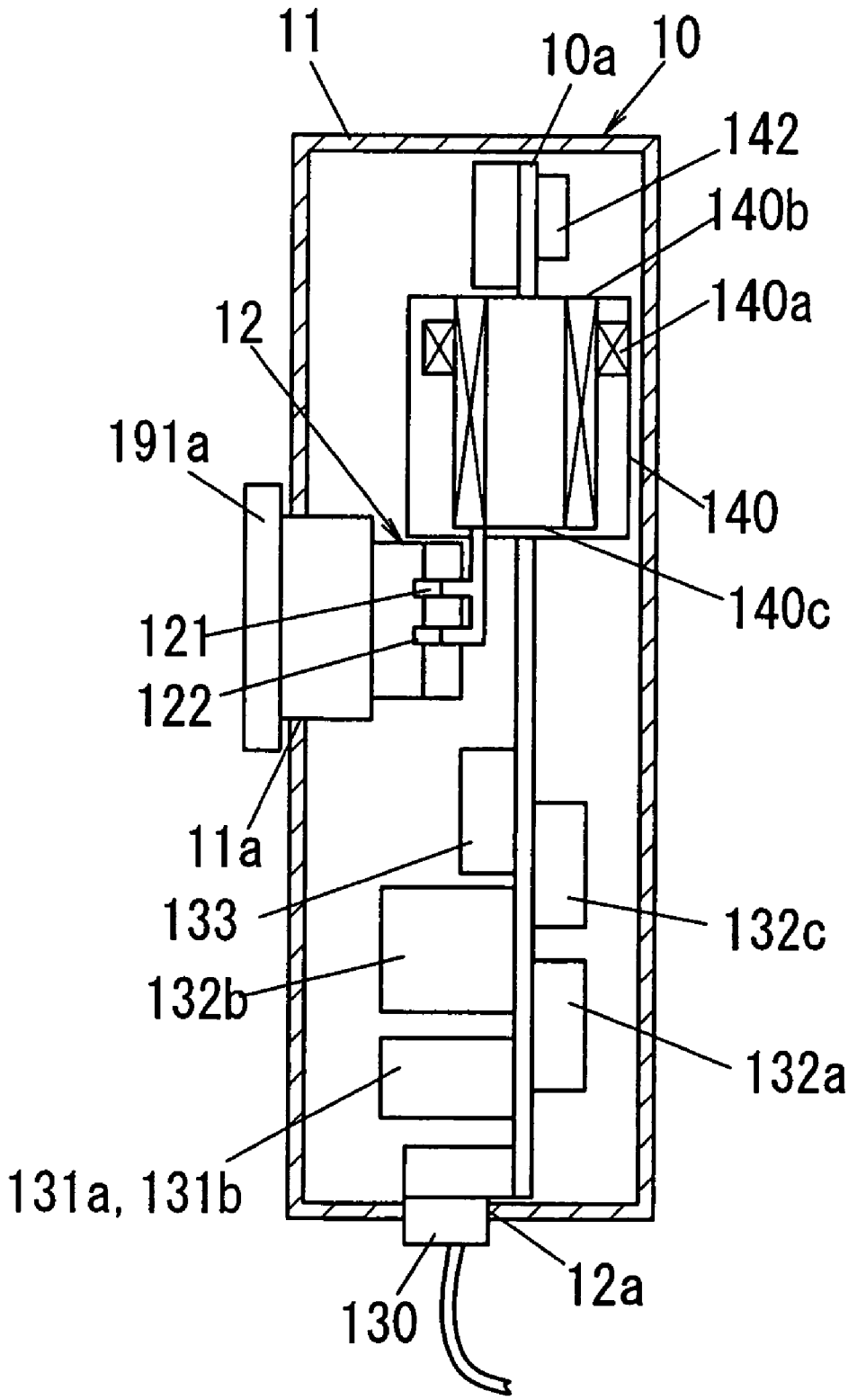
FIG. 6 is a sectional view of an electric ballast, in accordance with another alternate embodiment of the present embodiment.
Figure 7A:
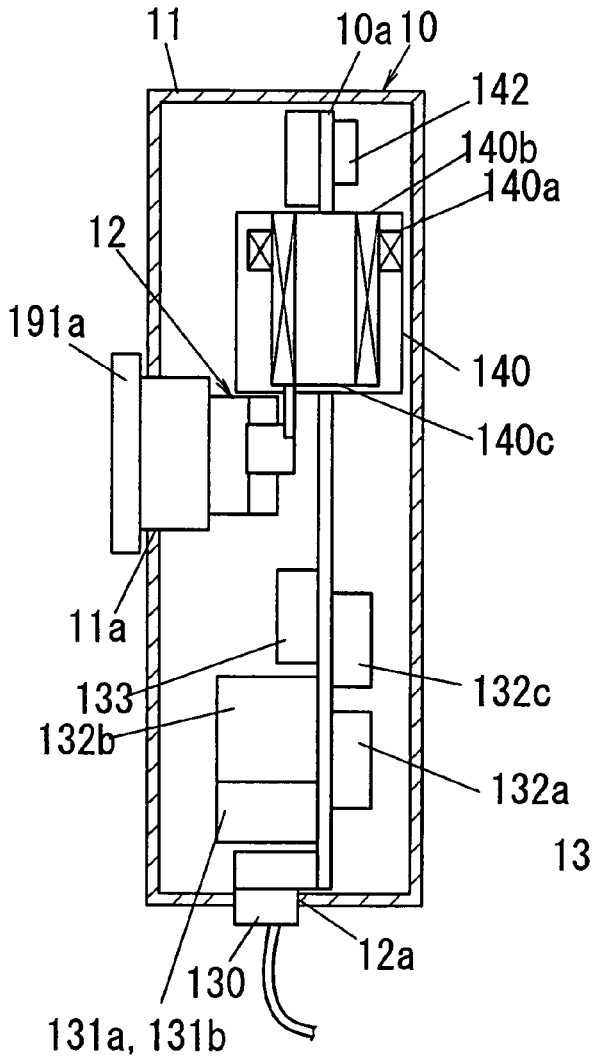
FIG. 7A is a sectional view of an electric ballast seen from the side, in accordance with other alternate embodiment of the present embodiment.
Figure 7B:
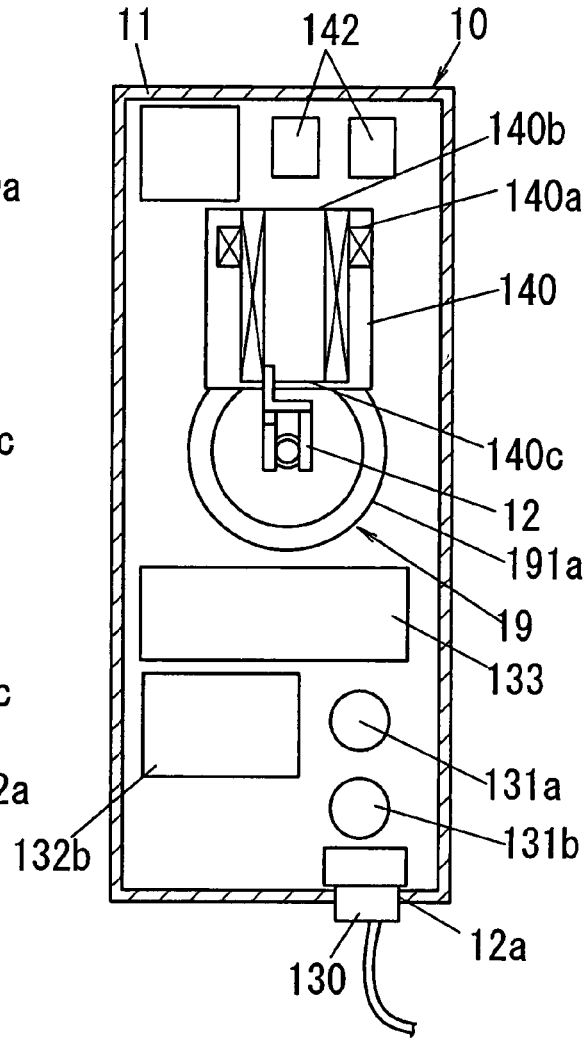
FIG. 7B is a sectional view of the electric ballast of FIG. 7A seen from the rear.

In a varied embodiment, as shown in FIG. 4, parts of the electric ballast 10 are mounted on the same substrate 10*a* instead of the substrates 13*a* and 14*a*. The pulse transformer 140 is inserted into a hole of the substrate 10*a* and then fixed on the substrate 10*a*. In FIG. 4, 140*a*, 140*b* and 140*c* are the primary winding, the secondary winding and a ferrite core of the transformer 140, respectively. However, the parts of the electric ballast 10 may be arranged as shown in FIGS. 5, 6, 7A and 7B. In FIG. 5, the transformer 140 is located at a diagonally lower rear side of the socket 12. In FIG. 6, the transformer 140 is located at a diagonally upper rear side of the socket 12 and is inserted into a hole of the substrate 10*a*. In FIGS. 7A and 7B, the output terminals of the socket 12 differ from those of FIG. 6. According to these configurations, thin shaped electric ballasts are obtained.

Figure 8:
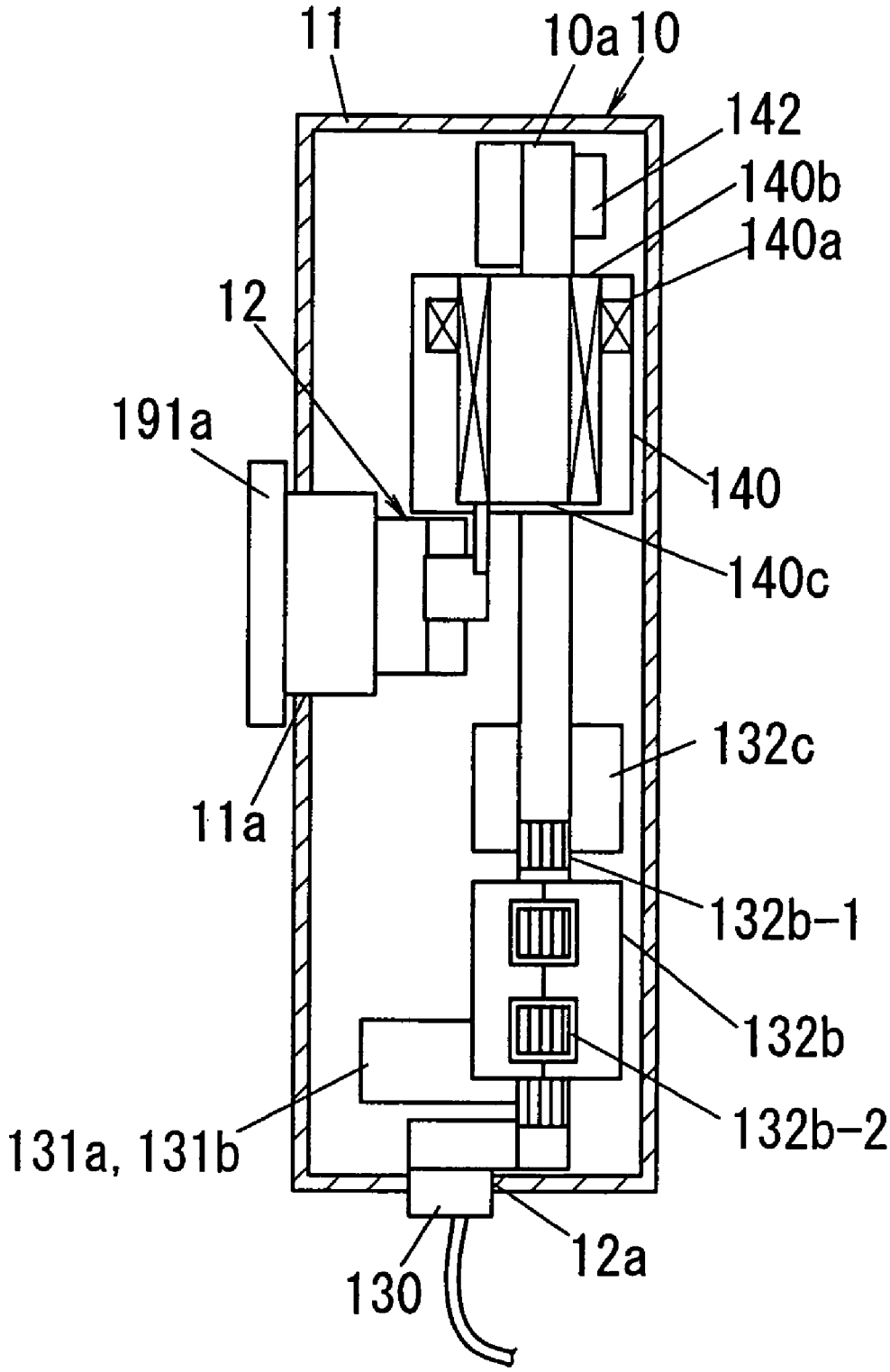
FIG. 8 is a sectional view of an electric ballast, in accordance with another varied embodiment of the present embodiment.
Figure 9:
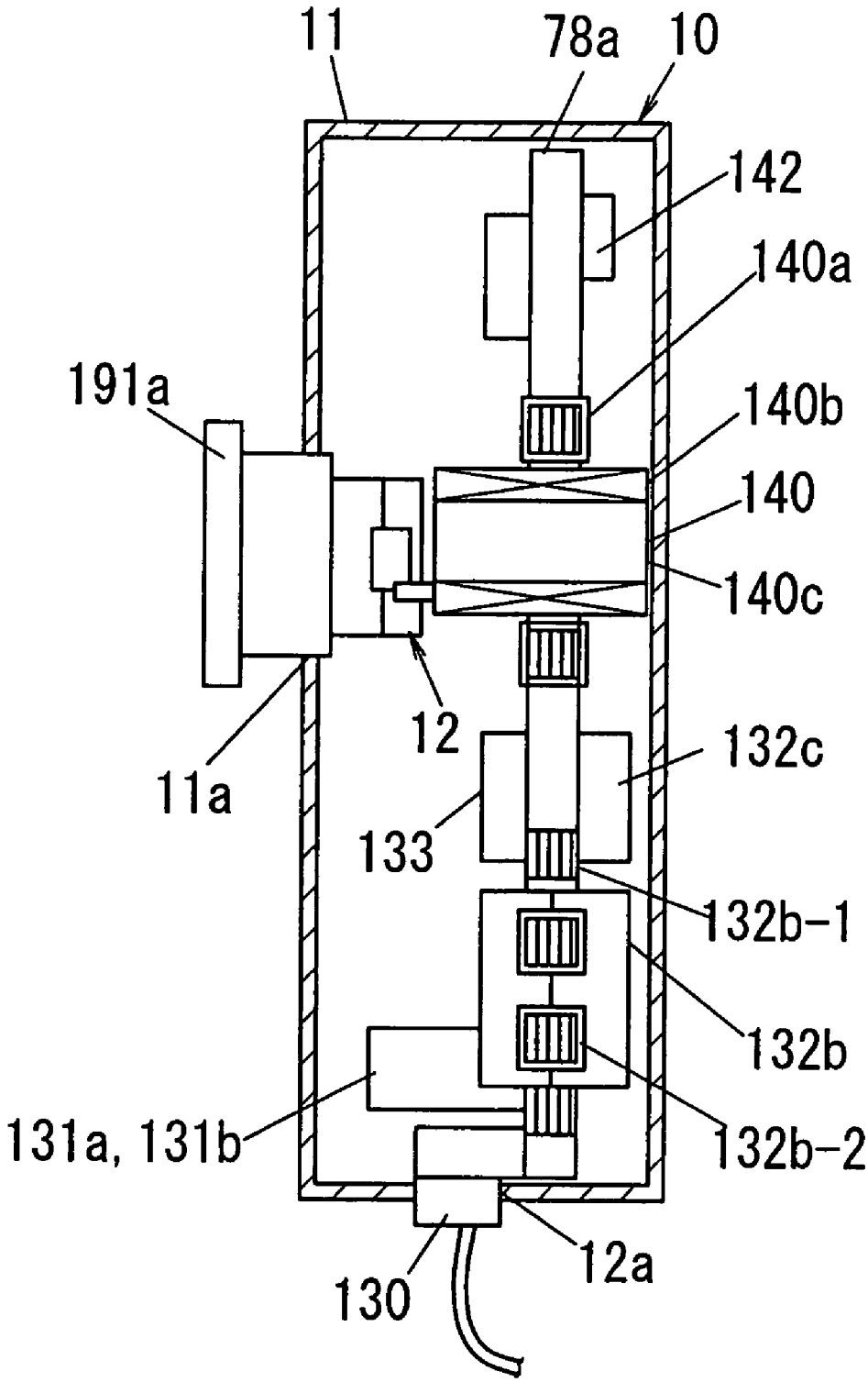
FIG. 9 is a sectional view of an electric ballast, in accordance with an alternate embodiment of the present embodiment.

In another modified embodiment, as shown in FIG. 8, the power converter 13 includes the transformer 132*b* with primary and secondary windings 132*b*-1 and 132*b*-2 each of which is formed of pattern wiring of the substrate (print board) 10*a*. As shown in FIG. 9, igniter 14 may also include the transformer 140 with the primary and secondary windings 140*a* and 140*b* each of which is formed of pattern wiring of the substrate 10*a*. According to these configurations, compact electric ballasts are obtained.

Figure 10:
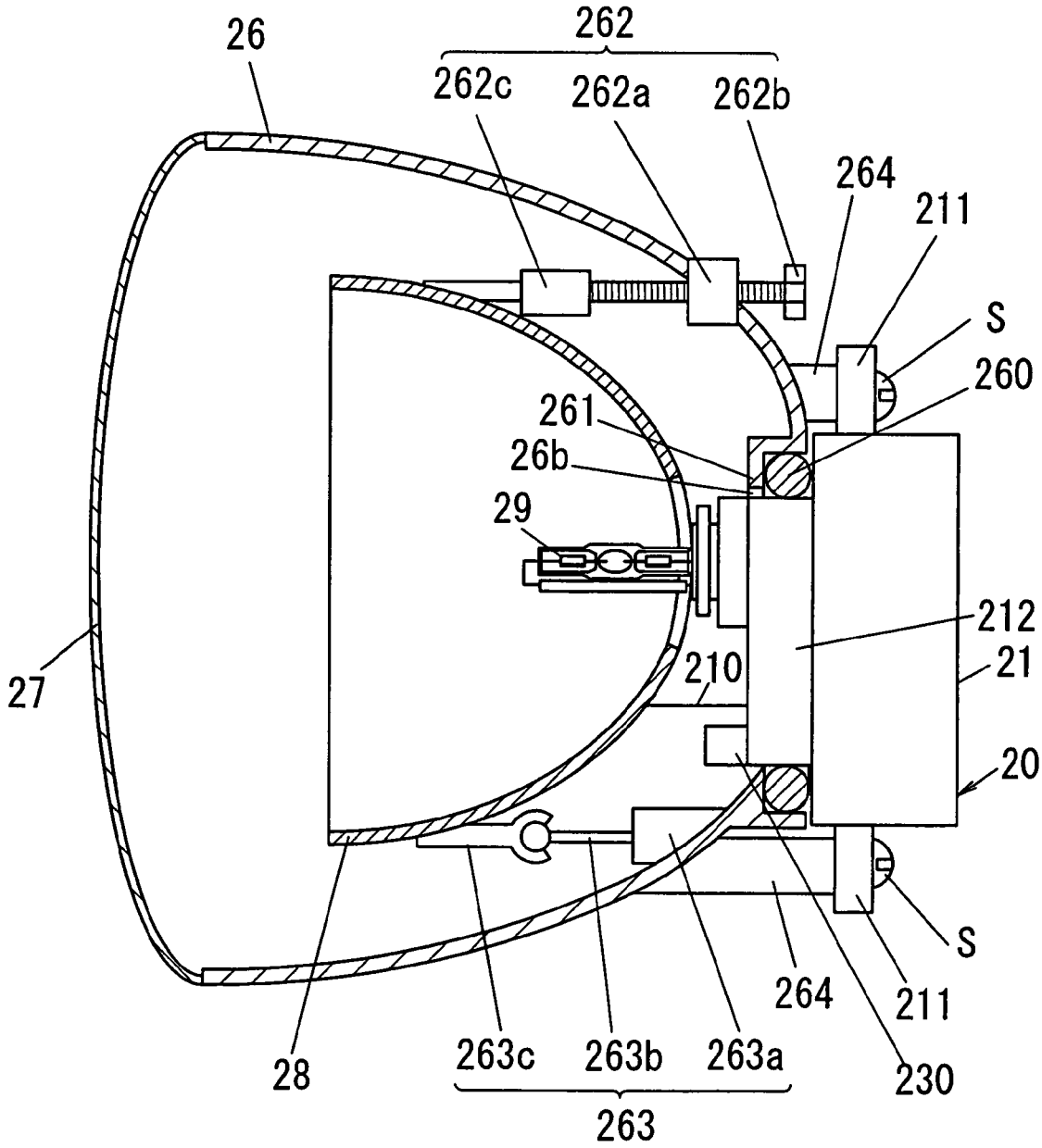
FIG. 10 is a sectional view of a lighting system, in accordance with a second embodiment of the present invention.

FIG. 10 shows a lighting system in accordance with a second embodiment of the present invention. The lighting system of FIG. 10 is a headlight, and is formed of a lamp housing 26, a front lens 27, a reflector 28, a discharge lamp 29 and an electric ballast 20. Mainly different points from the first embodiment are explained below.

In case of headlights, the reflector is usually connected with frame ground. The reflector 28 is also connected with frame ground.

The lamp housing 26 is provided with a pair of vertical movable supports 262 and 263 that adjust a vertical inclination of optical axis of the headlight, and a pair of horizontal movable supports (not shown) that adjust a horizontal inclination of optical axis of the headlight. The lamp housing 26 may be formed of resin or the like.

The vertical movable support 262 is formed of, for example, a nut holder 262*a*, a bolt 262*b* for aiming and a rib 262*c*. The holder 262*a* is fixed to a hole in the rear upper part of the lamp housing 26. The bolt 262*b* is screwed into the holder 262*a* so as to be inserted into the inside of the lamp housing 26. The rib 262*c* has a threaded hole into which the tip of the bolt 262*b* is screwed, and is fixed on the rear upper part of the reflector 28.

The vertical movable support 263 is formed of, for example, a boss 263*a*, a support axis 263*b* and a bearing 263*c*. The boss 263*a* is fixed on the inner face and the rear lower part of the lamp housing 26. The axis 263*b* has a sphere-shaped tip, and is supported with the boss 263*a* so as to extend the tip forward. The bearing 263*c* is fixed on the rear lower part of the reflector 28, and holds (grips) the tip of the axis 263*b*.

For example, the optical axis of the headlight can be inclined downward by turning the bolt 262*b* clockwise, while the optical axis can be inclined upward by turning the bolt 262*b* anti-clockwise. The horizontal movable supports are also formed in the same way as the vertical movable supports.

The lamp housing 26 is also provided with pillar-shaped bosses (each of which is denoted by 264) at the rear thereof, while a ballast housing 21 of the electric ballast 20 is provided with ribs (211) respectively corresponding to the bosses (264) at the sides thereof. Each boss 264 has a threaded hole, and each rib 211 has a through hole. Accordingly, by inserting each screw S as said fixing means into each through hole of the ribs (211) to fix each screw S into each threaded hole of the bosses (264), the ballast housing 21 can be fixed at the outside of the concave bottom 261 of the lamp housing 26. In this case, a rear opening 26*b* of the lamp housing 26 is closed with the ballast housing 21, and the rear opening 26*b* side is made waterproof with a ring-shaped seal packing 260 sandwiched between the both of them. The packing 260 is attached around a protrusion 212 in the front of the ballast housing 21.

In addition, before the ballast 20 is fixed at the rear of the lamp housing 26, the wire harness from said DC power source is connected with a power input coupler 230. The coupler 230 is then put in the lamp housing 26 when the ballast 20 is fixed at the rear of the lamp housing 26. On account of this, the wire harness and the coupler 230 need not be directly made waterproof. The wire harness may be inserted into the housing from a hole formed at the lower side of the lamp housing 26, or sandwiched between the lamp housing 26 or the ballast housing 21 and the seal packing 260. In case of the former, the hole may be closed with a seal such as silicon rubber or the like.

Moreover, the ballast housing 21 is electrically connected with the reflector 28 through a connector 210, and electrically connected with frame ground via the reflector 28. Accordingly, it is possible to achieve better shield effect of the ballast housing 21 with respect to noise from the lamp 29 and the need of a shield sheath in the lamp housing 26 can be eliminated. As a result, cost down and compact systems are achieved.

Figure 11:
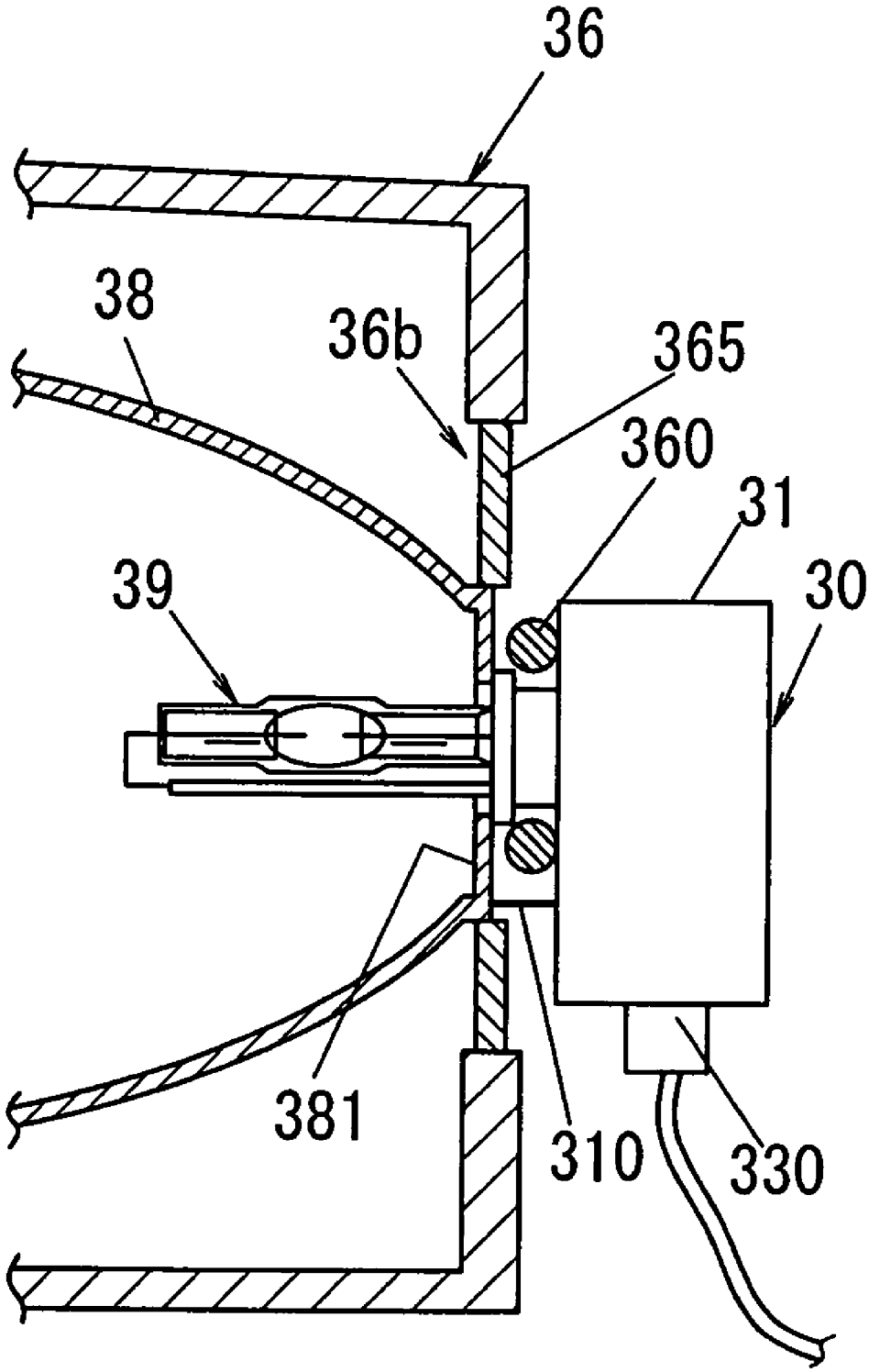
FIG. 11 is a sectional view of a lighting system, in accordance with a third embodiment of the present invention.

FIG. 11 shows a lighting system in accordance with a third embodiment of the present invention. The lighting system of FIG. 11 is, for example, a headlight, and is formed of a lamp housing 36, a front lens (not shown), a reflector 38, a discharge lamp 39 and an electric ballast 30. In FIG. 11, 330 and 360 are a power input coupler and a seal packing, respectively, and vertical and horizontal movable supports are not shown. Mainly different points from the second embodiment are explained below.

The lamp housing 36 further comprises a loop-shaped elastic coupling 365 with an inner peripheral edge and an outer peripheral edge. The inner peripheral edge and the outer peripheral edge of the coupling 365 are respectively joined to the rear of the reflector 38 (peripheral edge of the bottom 381) and the peripheral edge of the rear opening 36*b* of the lamp housing 36 so that the coupling 365 movably supports the reflector 38.

The ballast housing 31 of the ballast 30 is fixed on the rear (bottom 381) of the reflector 38 by a fixing means (not shown) such as, for example, screws, twist lock connectors or the like. The ballast housing 31 is also electrically connected with the reflector 38 through a connector 310.

Thus, since the ballast housing 31 is electrically connected with the reflector 38 through the connector 310, the ballast housing 31 is electrically connected with frame ground via the reflector 38. Accordingly, it is possible to achieve better shield effect of the ballast housing 31 with respect to noise from the lamp 39 and the need of a shield sheath in the lamp housing 36 can be eliminated. As a result, cost down and compact systems are achieved. In addition, a high beam and a low beam can be changed each other by moving the reflector 38.

Figure 12:
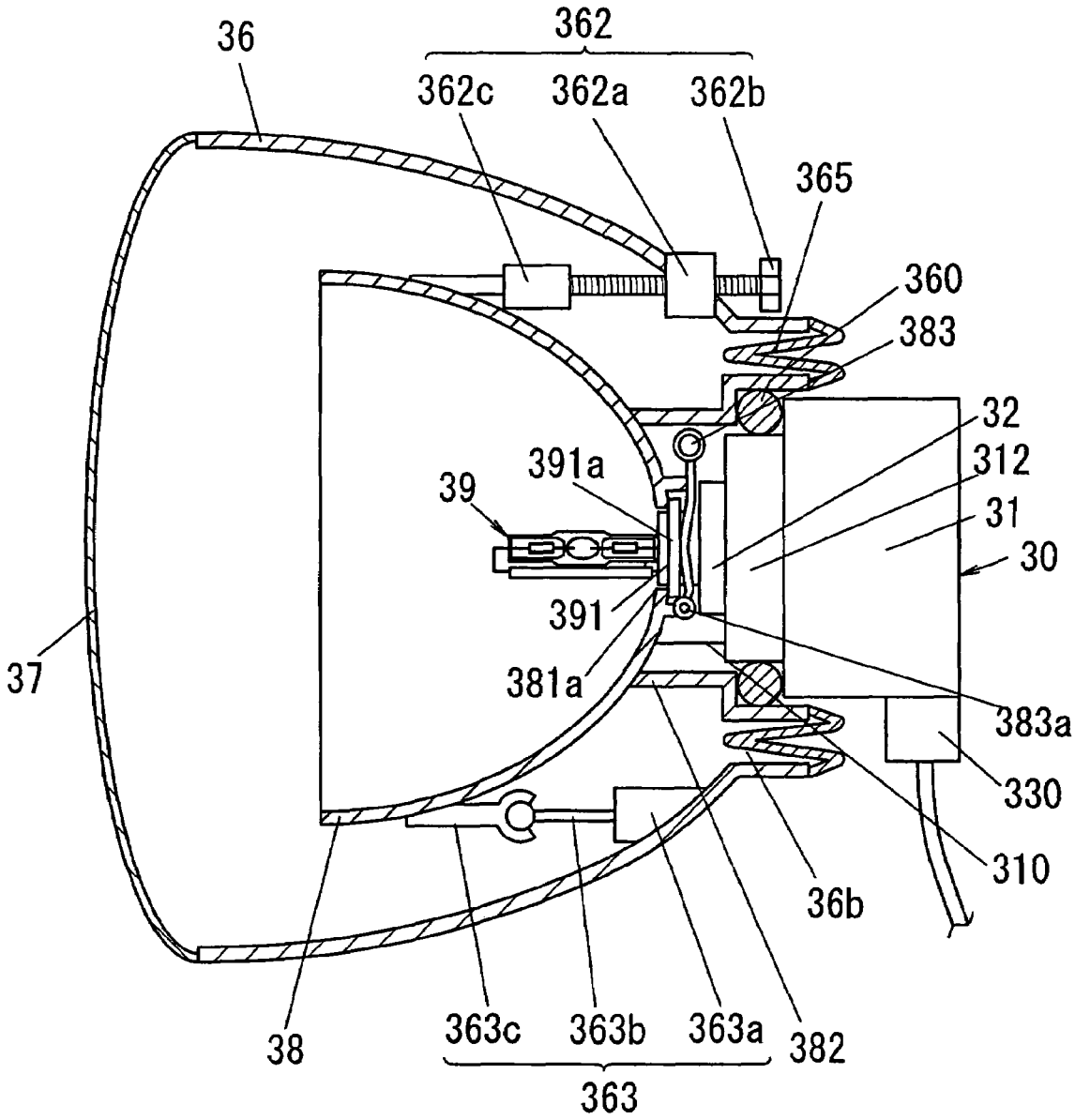
FIG. 12 is a sectional view of an electric ballast, in accordance with a varied embodiment of the present embodiment.

In a varied embodiment, as shown in FIG. 12, the loop-shaped elastic coupling 365 is, for example, a rubber molding or the like which permits mechanical expansion and contraction in the radial direction of the rear opening 36*b*. In FIG. 12, the inner peripheral edge and the outer peripheral edge of the coupling 365 are respectively joined to the opening edge of a cylindrical portion 382 formed at the rear of the reflector 38 and the peripheral edge of the rear opening 36*b* through, for example, glue, crimping, pressure welding or the like. Mainly different points from the third embodiment are explained below.

In FIG. 12, a hole 381*a* of the reflector 38 is smaller than a flange 391*a* of a single base 391 of the lamp 39, and the flange 391*a* is in contact with a peripheral edge portion of the hole 381*a* in the reflector 38. In this state, the flange 391*a* is fixed through an attachment 383 provided at the rear of the reflector 38. The attachment 383 can be turned around an axis 383*a* fixed at the lower side of the hole 381*a* in the reflector 38. Therefore, the lamp 39 can be fixed to the reflector 38 by turning the attachment 383 anti-clockwise, while the lamp 39 can be removed from the reflector 38 by turning the attachment 383 clockwise.

The ballast housing 31 has a substantially cylindrical side wall and is fixed at the rear of the reflector 38 by electrically and mechanically connecting a lamp socket 32 to the base 391 of the lamp 39 fixed to the reflector 38 with the attachment 383. In this case, since the packing 360 attached around a cylindrical protrusion 312 of the ballast housing 31 is fastened between the cylindrical portion 382 and the ballast housing 31, the inside of the lighting system of FIG. 12 is made waterproof. In FIG. 12, 362 and 363 are a pair of vertical movable supports. The vertical movable support 362 is formed of a nut holder 362*a*, a bolt 362*b* for aiming and a rib 362*c*, while the vertical movable support 363 is formed of a boss 363*a*, a support axis 363*b* and a bearing 363*c*.

According to the configuration of FIG. 12, compact systems are achieved and waterproof property is ensured. Moreover, since the ballast 30 is fixed at the rear of the reflector 38, the hole 381*a* of the reflector 38 need not be enlarged for adjustment of optical axis of the lamp 39. As a result, light of the lamp 39 can be preferably reflected toward the lens 37. The distribution design of light of the lamp 39 also becomes easy.

Figure 13:
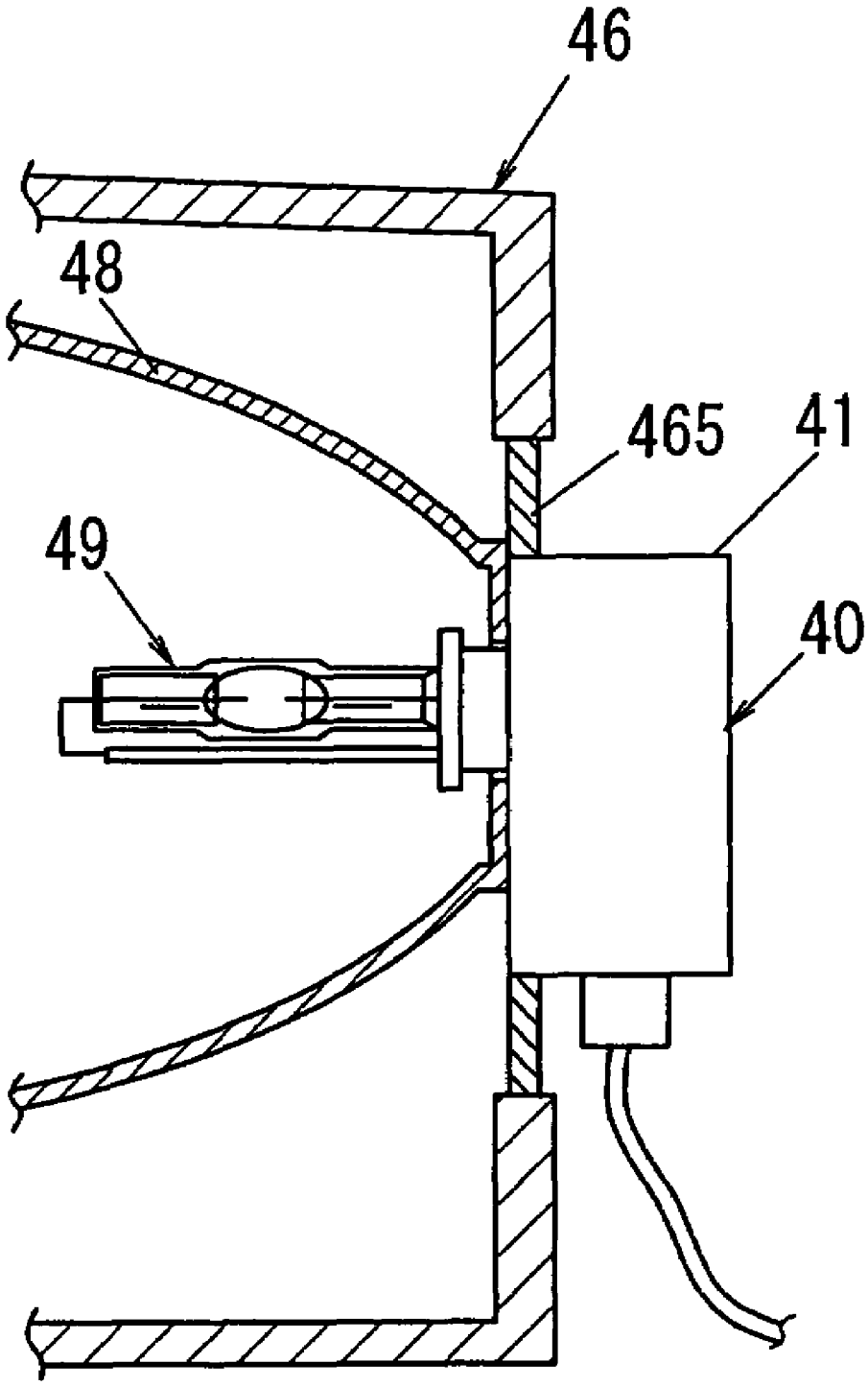
FIG. 13 is a sectional view of a lighting system, in accordance with a fourth embodiment of the present invention.

FIG. 13 shows a lighting system in accordance with a fourth embodiment of the present invention. The lighting system of FIG. 13 is, for example, a headlight, and is formed of a lamp housing 46, a front lens (not shown), a reflector 48, a discharge lamp 49 and an electric ballast 40. Mainly different points from the third embodiment are explained below.

The ballast housing 41 of the ballast 40 is directly fixed on the rear of the reflector 48 by a fixing means (not shown) such as, for example, screws, twist lock connectors or the like to be electrically connected with the reflector 48.

The lamp housing 46 further comprises a loop-shaped elastic coupling 465 with an inner peripheral edge and an outer peripheral edge. The inner peripheral edge and the outer peripheral edge of the coupling 465 are respectively joined to the ballast housing 41 and the peripheral edge of the rear opening 46*b* of the lamp housing 46 so that the coupling 465 movably supports the reflector 48 through the ballast housing 41.

Thus, since the ballast housing 41 is electrically connected with the reflector 48, the ballast housing 41 is electrically connected with frame ground via the reflector 48. Accordingly, it is possible to achieve better shield effect of the ballast housing 41 with respect to noise from the lamp 49 and the need of a shield sheath in the lamp housing 46 can be eliminated. As a result, cost down and compact systems are achieved. In addition, a high beam and a low beam can be changed each other by moving the reflector 48.

Although the present invention has been described with reference to certain preferred embodiments, numerous modifications and variations can be made by those skilled in the art without departing from the true spirit and scope of this invention.

The invention claimed is:

1. A lighting system comprising an electric ballast, wherein the lighting system comprises:

a lamp housing with a front opening and a rear opening;

a front lens closing the front opening;

a discharge lamp put in the lamp housing, and a reflector put in the lamp housing to reflect light of the lamp toward the lens;

wherein the electric ballast comprises:

a ballast housing formed of conductive materials;

a lamp socket put in the front of the ballast housing, said socket directly connecting with the lamp;

a power converter put in the ballast housing, the output of said power converter being electrically connected with the socket; and an igniter put in the front of the ballast housing, said igniter being electrically connected between the power converter and the socket;

wherein heat generating parts of the power converter are put in the rear of the ballast housing, the rear of said ballast housing functioning as a radiator, and wherein the electric ballast is attached to the outside of the lighting system so that the ballast housing closes the rear opening is electrically connected with frame ground via at least one of the lamp housing and the reflector.

2. The lighting system according to claim 1, further comprising a loop-shaped elastic coupling with an inner peripheral edge and an outer peripheral edge; wherein:

the inner peripheral edge and the outer peripheral edge of the elastic coupling are respectively joined to the rear of the reflector and the peripheral edge of the rear opening so that the elastic coupling movably supports the reflector; and the ballast housing is fixed on the rear of the reflector and also electrically connected with the reflector.

3. The lighting system according to claim 2, further comprising a filter located between the power converter and the igniter, said filter having two series capacitors connected in parallel with the lamp through the igniter, wherein the ballast housing is electrically connected between the series capacitors.

4. The lighting system according to claim 3, wherein the igniter includes a switch for trigger, said switch being a discharge gap for self-excitation or a semiconductor switch for separately-excitation.

5. The lighting system according to claim 3, wherein the power converter and the igniter are mounted on the same substrate.

6. The lighting system according to claim 3, wherein at least one of the power converter and the igniter includes a transformer with windings each of which is formed of pattern wiring of a substrate.

7. The lighting system according to claim 1, further comprising a loop-shaped elastic coupling with an inner peripheral edge and an outer peripheral edge; wherein:

the ballast housing is fixed on the rear of the reflector and also electrically connected with the reflector; and the inner peripheral edge and the outer peripheral edge of the elastic coupling are respectively joined to the ballast housing and the peripheral edge of the rear opening so that the elastic coupling movably supports the reflector through the ballast housing.

8. The lighting system according to claim 7, further comprising a filter located between the power convener and the igniter, said filter having two series capacitors connected in parallel with the lamp through the igniter, wherein the ballast housing is electrically connected between the series capacitors.

9. The lighting system according to claim 8, wherein the igniter includes a switch for trigger, said switch being a discharge gap for self-excitation or a semiconductor switch for separately-excitation.

10. The lighting system according to claim 8, wherein the power converter and the igniter are mounted on the same substrate.

11. The lighting system according to claim 8, wherein at least one of the power converter and the igniter includes a transformer with windings each of which is formed of pattern wiring of a substrate.

12. The lighting system according to claim 1, wherein the ballast housing is fixed on the lamp housing with the rear opening close, and also electrically connected with the lamp housing.

13. The lighting system according to claim 12, further comprising a filter located between the power converter and the igniter, said filter having two series capacitors connected in parallel with the lamp through the igniter, wherein the ballast housing is electrically connected between the series capacitors.

14. The lighting system according to claim 13, wherein the igniter includes a switch for trigger, said switch being a discharge gap for self-excitation or a semiconductor switch for separately-excitation.

15. The lighting system according to claim 13, wherein the power converter and the igniter are mounted on the same substrate.

16. The lighting system according to claim 13, wherein at least one of the power converter and the igniter includes a transformer with windings each of which is formed of pattern wiring of a substrate.

* * * * *